United States Patent [19]

Glanz

[11] Patent Number: 4,470,057

[45] Date of Patent: Sep. 4, 1984

[54] THERMALLY-RESPONSIVE RECORD MATERIAL

[75] Inventor: Kenneth D. Glanz, Appleton, Wis.

[73] Assignee: Appleton Papers Inc., Appleton, Wis.

[21] Appl. No.: 478,199

[22] Filed: Mar. 24, 1983

Related U.S. Application Data

[63] Continuation-in-part of Ser. No. 401,678, Jul. 26, 1982, abandoned.

[51] Int. Cl.[3] ..... B41M 5/18

[52] U.S. Cl. ..... 346/209; 346/208; 346/214; 346/216; 346/221

[58] Field of Search ..... 282/27.5; 427/150, 151; 428/320.8, 411, 488, 537, 913, 914

[56] References Cited

FOREIGN PATENT DOCUMENTS 3242262 5/1983 Fed. Rep. of Germany ..... 346/209
2367618 5/1978 France ..... 346/209
0064593 4/1982 Japan ..... 346/209
0201693 12/1982 Japan ..... 346/216

OTHER PUBLICATIONS

*Hackh's Chemical Dictionary,* 3rd Ed., 1944, p. 88.
Patent Abstracts of Japan, vol. 6, No. 142, (M-146), (1020), Jul. 31, 1982.
Chemical Abstracts, vol. 99, No. 14, Oct. 1983, p. 535, No. 113730a.

*Primary Examiner*—Bruce H. Hess
*Attorney, Agent, or Firm*—E. Frank McKinney; Paul S. Phillips, Jr.

[57] ABSTRACT

A thermally-sensitive color-forming composition is disclosed which comprises chromogenic material, acidic developer material and a phenylhydroxynaphthoate compound. Record material comprising this color-forming composition exhibits improved color-forming efficiency and/or image density.

11 Claims, No Drawings

THERMALLY-RESPONSIVE RECORD MATERIAL

This application is a continuation-in-part of copending application Ser. No. 401,678, filed July 26, 1982, now abandoned.

This invention relates to thermally-responsive record material. It more particularly relates to such record material in the form of sheets coated with color-forming systems comprising chromogenic material and acidic color developer material. This invention particularly concerns a thermally-responsive record material with improved color-forming efficiency and/or image density.

Thermally-responsive record material systems are well known in the art and are described in many patents, for example U.S. Pat. Nos. 3,539,375, 3,674,535, 3,746,675, 4,151,748, 4,181,771 and 4,246,318 which are hereby incorporated by reference. In these systems, basic chromogenic material and acidic color developer material are contained in a coating on a substrate which, when heated to a suitable temperature, melts or softens to permit said materials to react, thereby producing a colored mark.

In the field of thermally-responsive record material, thermal response is defined as the temperature at which a thermally-responsive record material produces a colored image of sufficient intensity (density). The temperature of imaging varies with the type of application of the thermally-responsive product and the equipment in which the imaging is to be performed. The ability to shift the temperature at which a satisfactorily intense thermal image is produced for any given combination of chromogenic material and developer material is a much sought after and very valuable feature.

Also in the field of thermally-responsive record material, the ability to increase the efficiency of the thermal image formation process has decided advantages. Principal among these are the ability to obtain the same image intensity with a lower amount of reactants or, alternatively, to obtain a more intense image with the same amount of reactants.

It is an object of the present invention to provide a thermally-responsive recording material having enhanced image intensity.

It is also an object of the present invention to provide a thermally-responsive recording material having an improved thermal response.

It is another object of the present invention to provide a thermally-responsive record material comprising a support member bearing a thermally-sensitive color-forming composition comprising chromogenic material and acidic developer material in contiguous relationship, whereby the melting or sublimation of either material produces a change in color by reaction between the two, a phenylhydroxynaphthoate compound, and a suitable binder therefor.

It is yet another object of the present invention to provide a thermally-responsive record material comprising a support member bearing a thermally-sensitive color-forming composition comprising chromogenic material and acidic developer material in contiguous relationship, whereby the melting or sublimation of either material produces a change in color by reaction between the two, a phenylhydroxynaphthoate compound selected from the group consisting of phenyl-1-hydroxy-2-naphthoate and phenyl-3-hydroxy-2-naphthoate, and a suitable binder therefor.

In accordance with the present invention, it has been found that these and other objectives may be attained by employing a thermally-sensitive color-forming composition comprising chromogenic material and acidic developer material, phenylhydroxynaphthoate and binder material. The unexpected feature of this composition is that, even though the phenylhydroxynaphthoate does not, by itself, function to a significant degree as a developer material, its inclusion with prior art thermally-sensitive color-forming compositions results in a composition possessing improved thermal response and/or increased efficiency of thermal image formation.

The color-forming composition (or system) of the record material of this invention comprises chromogenic material in its substantially colorless state and acidic developer material such as, for example, phenolic compounds. The color-forming system relies upon melting or subliming one or more of the components to achieve reactive, color-producing contact.

The record material includes a substrate or support material which is generally in sheet form. For purposes of this invention, sheets also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of this invention resides in the color-forming composition coated on the substrate. The kind or type of substrate material is not critical.

The components of the color-forming system are in a contiguous relationship, substantially homogeneously distributed throughout the coated layer material deposited on the substrate. In manufacturing the record material, a coating composition is prepared which includes a fine dispersion of the components of the color-forming system, polymeric binder material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as Carnuba wax; synthetic waxes; lubricants such as zinc stearate; wetting agents and defoamers.

The color-forming system components are substantially insoluble in the dispersion vehicle (preferably water) and are ground to an individual average particle size of between about 1 micron to about 10 microns, preferably about 3 microns. The polymeric binder material is substantially vehicle soluble although latexes are also eligible in some instances. Preferred water soluble binders include polyvinyl alcohol, hydroxy ethylcellulose, methylcellulose, methyl-hydroxypropylcellulose, starch, modified starches, gelatin and the like. Eligible latex materials include polyacrylates, polyvinylacetates, polystyrene, and the like. The polymeric binder is used to protect the coated materials from brushing and handling forces occasioned by storage and use of the thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible chromogenic compounds, such as the phthalide, leucauramine and fluoran compounds, for use in the color-forming system are well known color-forming compounds. Examples of the compounds include Crystal Violet Lactone (3,3-bis(4-dimethylaminophenyl)-6-dimethylaminophthalide, U.S. Pat. No. Re. 23,024); phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-fluoran (U.S. Pat. No. 3,681,390); 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]-pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; and 3'-phenyl-7-dibenzylamino-2,2'-spiro-di-[2H-1-benzopyran].

Examples of eligible acidic developer material include the compounds listed in U.S. Pat. No. 3,539,375 as phenolic reactive material, particularly the monophenols and diphenols. Eligible acidic developer material also includes, without being considered as limiting, the following compounds which may be used individually or in mixtures: 4,4'-isopropylindinediphenol (Bisphenol A); p-hydroxybenzaldehyde; p-hydroxybenzophenone; p-hydroxypropiophenone; 2,4-dihydroxybenzophenone; 1,1-bis(4-hydroxy-3-methylphenyl)-cyclohexane; 1,1-bis(4-hydroxyphenyl)cyclohexane; salicylanilide; 4-hydroxy-2-methylacetophenone; 2-acetylbenzoic acid; m-hydroxyacetanilide; p-hydroxyacetanilide; 2,4-dihydroxyacetophenone; 4-hydroxy-4'-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl)-5-methylhexane; ethyl-4,4-bis(4-hydroxyphenyl)-pentanoate; n-propyl-4,4-bis(4-hydroxyphenyl)pentanoate; isopropyl-4,4-bis(4-hydroxyphenyl)pentanoate; methyl-4,4-bis(4-hydroxyphenyl)pentanoate; 3,3-bis(4-hydroxyphenyl)-pentane; 4,4-bis(4-hydroxyphenyl)-heptane; 2,2-bis(4-hydroxyphenyl)-1-phenylpropane; 2,2-bis(4-hydroxyphenyl)butane; 2,2'-methylene-bis(4-ethyl-6-tertiarybutyl phenol); 4-hydroxycoumarin; 7-hydroxy-4-methylcoumarin; 2,2'-methylene-bis(4-octyl phenol); 4,4'-sulfonyldiphenol; 4,4'-thiobis(6-tertiarybutyl-m-cresol); methyl-p-hydroxybenzoate; n-propyl-p-hydroxybenzoate; benzyl-p-hydroxybenzoate. Preferred among these are the phenolic developer compounds. More preferred among the phenol compounds are 4,4'-isopropylindinediphenol, ethyl-4,4-bis(4-hydroxyphenyl)-pentanoate, n-propyl-4,4-bis(4-hydroxyphenyl)pentanoate, isopropyl-4,4-bis(4-hydroxyphenyl)pentanoate, methyl-4,4-bis(4-hydroxyphenyl)pentanoate, 2,2-bis(4-hydroxyphenyl)-4-methylpentane, p-hydroxybenzophenone, 2,4-dihydroxybenzophenone, and 1,1-bis(4-hydroxyphenyl)cyclohexane. Acid compounds of other kinds and types are eligible. Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen.

The following examples are given to illustrate some of the features of the present invention and should not be considered as limiting. In these examples all parts are by weight and all measurements are in the metric system, unless otherwise stated.

In all examples illustrating the present invention a dispersion of a particular system component was prepared by milling the component in an aqueous solution of the binder until a particle size of between about 1 micron and 10 microns was achieved. The milling was accomplished in an attritor. The desired average particle size was about 3 microns in each dispersion.

In these examples separate dispersions comprising the chromogenic compound (Component A), the acidic developer material (Component B) and the phenylhydroxynaphthoate (Component C) were prepared.

| Material | Parts |
|---|---|
| Component A | |
| Chromogenic compound | 13.60 |
| Binder, 10% polyvinyl alcohol in water | 24.00 |
| Water | 42.35 |
| Defoamer & dispersing agent* | 0.05 |
| Component B | |
| Acidic developer material | 13.60 |
| Binder, 10% polyvinyl alcohol in water | 24.00 |
| Water | 42.35 |
| Defoamer & dispersing agent* | 0.05 |
| Component C | |
| Phenylhydroxynaphthoate | 13.60 |
| Binder, 10% polyvinyl alcohol in water | 24.00 |
| Water | 42.35 |
| Defoamer & dispersing agent* | 0.05 |

*Equal parts of the defoamer Nopko NDW (sulfonated caster oil produced by Nopko Chemical Company) and the dispersing agent Surfynol 104 (a di-tertiary acetylene glycol surface active agent produced by Air Products and Chemicals Inc.) were employed.

The chromogenic compounds employed in the examples are listed in Table 1.

TABLE 1

| Chromogenic Compound | Designation of Dispersion Comprising said Chromogenic Compound |
|---|---|
| 3-diethylamino-6-methyl-7-anilinofluoran | A-1 |
| 7-(1-ethyl-2-methylindol-3-yl)-7-(4-diethylamino-2-ethoxyphenyl)-5,7-dihydrofuro[3,4-b]pyridin-5-one | A-2 |
| 3-diethylamino-7-(2-chloroanilino)fluroan | A-3 |
| 3-(N—methylcyclohexylamino)-6-methyl-7-anilinofluoran | A-4 |
| 7-(1-octyl-2-methylindol-3-yl)-7-(4-diethylamino-2-ethoxyphenyl)-5,7-dihydrofuro[3,4-b]pyridin- | A-5 |

TABLE 1-continued

| Chromogenic Compound | Designation of Dispersion Comprising said Chromogenic Compound |
|---|---|
| 5-one | |
| 3'-phenyl-7-dibenzylamino-2,2'-spiro-di-[2H—1-benzopyran] | A-6 |

The acidic developer material employed in the examples are listed in Table 2.

TABLE 2

| Acidic Developer Compound | Designation of Dispersion Comprising said Developer Compound |
|---|---|
| 4,4'-isopropylindinediphenol (Bisphenol A) | B-1 |
| p-hydroxybenzaldehyde | B-2 |
| p-hydroxybenzophenone | B-3 |
| p-hydroxypropiophenone | B-4 |
| 2,4-dihydroxybenzophenone | B-5 |
| 1,1-bis(4-hydroxy-3-methylphenyl)-cyclohexane | B-6 |
| 1,1-bis(4-hydroxyphenyl)cyclo-hexane | B-7 |
| salicylanilide | B-8 |
| 4-hydroxy-2-methylacetophenone | B-9 |
| 2-acetylbenzoic acid | B-10 |
| m-hydroxyactanilide | B-11 |
| p-hydroxyacetanilide | B-12 |
| 2,4-dihydroxyacetophenone | B-13 |
| 4-hydroxy-4'-methylbenzophenone | B-14 |
| 4,4'-dihydroxybenzophenone | B-15 |
| 2,2-bis(4-hydroxyphenyl)-4-methylpentane | B-16 |
| benzyl 4-hydroxyphenyl ketone | B-17 |
| 2,2-bis(4-hydroxyphenyl)-5-methylhexane | B-18 |
| ethyl-4,4-bis(4-hydroxyphenyl)-pentanoate | B-19 |
| 3,3-bis(4-hydroxyphenyl)-pentane | B-20 |
| 4,4-bis(4-hydroxyphenyl)-heptane | B-21 |
| 2,2-bis(4-hydroxyphenyl)-1-phenylpropane | B-22 |
| 2,2-Bis(4-hydroxyphenyl)butane | B-23 |
| 2,2'-methylene-bis(4-ethyl-6-tertiarybutyl phenol) | B-24 |
| 4-hydroxycoumarin | B-25 |
| 7-hydroxy-4-methylcoumarin | B-26 |
| 2,2'-methylene-bis(4-octylphenol) | B-27 |
| n-propyl-4,4-bis(4-hydroxy-phenyl)pentonate | B-28 |
| isopropyl-4,4-bis(4-hydroxy-phenyl)pentonate | B-29 |
| 4,4'-sulfonyl diphenol | B-30 |
| 4,4'-thiobis(6-tertbutyl-m-cresol) | B-31 |
| methyl-p-hydroxybenzoate | B-32 |
| n-propyl-p-hydroxybenzoate | B-33 |
| benzyl-p-hydroxybenzoate | B-34 |
| methyl-4,4-bis(4-hydroxy-phenyl)pentanoate | B-35 |

The phenylhydroxynaphthoate compounds employed in the examples are listed in Table 3.

TABLE 3

| Compound | Designation of Dispersion Comprising said Compound |
|---|---|
| phenyl-1-hydroxy-2-naphthoate | C-1 |
| phenyl-3-hydroxy-2-naphthoate | C-2 |

Mixtures of dispersions A and B (controls), mixtures of dispersions A and C (controls) and mixtures of dispersions A, B and C (examples of the invention) were made. In some cases one or more of the following materials was added to the resulting mixture:

1. a 68% kaolin clay slurry in water (designated hereinbelow as "clay")
2. a 10% solution of polyvinyl alcohol in water (designated hereinbelow as "PVA")
3. water In Table 4 are listed each of these mixtures, including the components added and the parts by weight of each.

TABLE 4

| Example | Components | Parts |
|---|---|---|
| 1 | Dispersion A-1 | 1.0 |
| | Dispersion B-1 | 6.5 |
| | Dispersion C-1 | 6.5 |
| Control 1 | Dispersion A-1 | 1.0 |
| | Dispersion B-1 | 13.0 |
| 2-1 | Dispersion A-1 | 1.0 |
| | Dispersion B-1 | 9.0 |
| | Dispersion C-1 | 1.0 |
| 2-2 | Dispersion A-1 | 1.0 |
| | Dispersion B-1 | 8.0 |
| | Dispersion C-1 | 2.0 |
| 2-3 | Dispersion A-1 | 1.0 |
| | Dispersion B-1 | 2.0 |
| | Dispersion C-1 | 8.0 |
| Control 2 | Dispersion A-1 | 1.0 |
| | Dispersion B-1 | 10.0 |
| 3 | Dispersion A-1 | 1.0 |
| | Dispersion B-1 | 6.5 |
| | Dispersion C-1 | 1.5 |
| | Clay | 1.2 |
| | PVA | 2.0 |
| Control 3 | Dispersion A-1 | 1.0 |
| | Dispersion B-1 | 6.5 |
| | Clay | 1.5 |
| | PVA | 2.0 |
| 4 | Dispersion A-1 | 1.0 |
| | Dispersion B-1 | 4.9 |
| | Dispersion C-2 | 1.4 |
| | Clay | 1.5 |
| | PVA | 3.4 |
| Control 4 | Dispersion A-1 | 1.0 |
| | Dispersion B-1 | 4.9 |
| | Clay | 1.8 |
| | PVA | 3.8 |
| 5 | Dispersion A-1 | 0.5 |
| | Dispersion A-3 | 0.5 |
| | Dispersion B-1 | 4.9 |
| | Dispersion C-1 | 1.4 |
| | Clay | 1.5 |
| | PVA | 3.2 |
| Control 5 | Dispersion A-1 | 0.5 |
| | Dispersion A-3 | 0.5 |
| | Dispersion B-1 | 4.9 |
| | Clay | 1.8 |
| | PVA | 3.6 |
| 6 | Dispersion A-1 | 0.5 |
| | Dispersion A-4 | 0.5 |
| | Dispersion B-1 | 4.9 |
| | Dispersion C-1 | 1.4 |
| | Clay | 1.5 |
| | PVA | 3.4 |
| Control 6 | Dispersion A-1 | 0.5 |
| | Dispersion A-4 | 0.5 |
| | Dispersion B-1 | 4.9 |
| | Clay | 1.8 |
| | PVA | 3.8 |
| 7 | Dispersion A-2 | 0.5 |
| | Dispersion B-1 | 4.9 |
| | Dispersion C-1 | 1.4 |
| | Clay | 1.5 |
| | PVA | 3.4 |
| | Water | 2.4 |
| Control 7 | Dispersion A-2 | 0.5 |
| | Dispersion B-1 | 4.9 |
| | Clay | 1.8 |
| | PVA | 3.8 |
| | Water | 2.4 |
| 8 | Dispersion A-5 | 1.0 |

TABLE 4-continued

| Example | Components | Parts |
|---|---|---|
| | Dispersion B-1 | 4.9 |
| | Dispersion C-1 | 1.4 |
| | Clay | 1.5 |
| | PVA | 3.4 |
| | Water | 1.5 |
| Control 8 | Dispersion A-5 | 1.0 |
| | Dispersion B-1 | 4.9 |
| | Clay | 1.8 |
| | PVA | 3.9 |
| | Water | 2.1 |
| 9 | Dispersion A-1 | 1.0 |
| | Dispersion B-2 | 6.5 |
| | Dispersion C-1 | 1.5 |
| | Clay | 1.1 |
| | PVA | 2.0 |
| Control 9 | Dispersion A-1 | 1.0 |
| | Dispersion B-2 | 6.5 |
| | Clay | 1.5 |
| | PVA | 2.0 |
| 10 | Dispersion A-1 | 1.0 |
| | Dispersion B-3 | 4.9 |
| | Dispersion C-1 | 1.4 |
| | Clay | 1.4 |
| | PVA | 3.8 |
| Control 10 | Dispersion A-1 | 1.0 |
| | Dispersion B-3 | 4.9 |
| | Clay | 1.8 |
| | PVA | 3.8 |
| 11 | Dispersion A-2 | 0.5 |
| | Dispersion B-3 | 4.9 |
| | Dispersion C-1 | 1.4 |
| | Clay | 1.5 |
| | PVA | 3.9 |
| | Water | 2.4 |
| Control 11 | Dispersion A-2 | 0.5 |
| | Dispersion B-3 | 4.9 |
| | Clay | 1.8 |
| | PVA | 3.9 |
| | Water | 2.4 |
| 12 | Dispersion A-1 | 1.0 |
| | Dispersion B-4 | 4.9 |
| | Dispersion C-1 | 1.4 |
| | Clay | 1.4 |
| | PVA | 3.8 |
| Control 12 | Dispersion A-1 | 1.0 |
| | Dispersion B-4 | 4.9 |
| | Clay | 1.8 |
| | PVA | 3.8 |
| 13 | Dispersion A-1 | 1.0 |
| | Dispersion B-5 | 4.9 |
| | Dispersion C-1 | 1.4 |
| | Clay | 1.4 |
| | PVA | 3.8 |
| Control 13 | Dispersion A-1 | 1.0 |
| | Dispersion B-5 | 4.9 |
| | Clay | 1.8 |
| | PVA | 3.8 |
| 14 | Dispersion A-2 | 0.5 |
| | Dispersion B-5 | 4.9 |
| | Dispersion C-1 | 1.4 |
| | Clay | 1.5 |
| | PVA | 3.9 |
| | Water | 2.4 |
| Control 14 | Dispersion A-2 | 0.5 |
| | Dispersion B-5 | 4.9 |
| | Clay | 1.8 |
| | PVA | 3.9 |
| | Water | 2.4 |
| 15 | Dispersion A-1 | 1.0 |
| | Dispersion B-6 | 4.9 |
| | Dispersion C-1 | 1.4 |
| | Clay | 1.4 |
| | PVA | 3.4 |
| Control 15 | Dispersion A-1 | 1.0 |
| | Dispersion B-6 | 4.9 |
| | Clay | 1.8 |
| | PVA | 3.8 |
| 16 | Dispersion A-1 | 1.0 |
| | Dispersion B-7 | 4.9 |
| | Dispersion C-1 | 1.4 |
| | Clay | 1.5 |

TABLE 4-continued

| Example | Components | Parts |
|---|---|---|
| | PVA | 3.4 |
| Control 16 | Dispersion A-1 | 1.0 |
| | Dispersion B-7 | 4.9 |
| | Clay | 1.8 |
| | PVA | 3.8 |
| 17 | Dispersion A-1 | 1.0 |
| | Dispersion B-8 | 4.9 |
| | Dispersion C-1 | 1.4 |
| | Clay | 1.5 |
| | PVA | 3.4 |
| Control 17 | Dispersion A-1 | 1.0 |
| | Dispersion B-8 | 4.9 |
| | Clay | 1.8 |
| | PVA | 3.8 |
| 18 | Dispersion A-2 | 1.0 |
| | Dispersion B-8 | 4.9 |
| | Dispersion C-1 | 1.4 |
| | Clay | 1.5 |
| | PVA | 3.4 |
| Control 18 | Dispersion A-2 | 1.0 |
| | Dispersion B-8 | 4.9 |
| | Clay | 1.8 |
| | PVA | 3.8 |
| 19 | Dispersion A-1 | 1.0 |
| | Dispersion B-9 | 4.9 |
| | Dispersion C-1 | 1.4 |
| | Clay | 1.5 |
| | PVA | 3.4 |
| Control 19 | Dispersion A-1 | 1.0 |
| | Dispersion B-9 | 4.9 |
| | Clay | 1.8 |
| | PVA | 3.8 |
| 20 | Dispersion A-1 | 1.0 |
| | Dispersion B-10 | 4.9 |
| | Dispersion C-1 | 1.4 |
| | Clay | 1.5 |
| | PVA | 3.4 |
| Control 20 | Dispersion A-1 | 1.0 |
| | Dispersion B-10 | 4.9 |
| | Clay | 1.8 |
| | PVA | 3.8 |
| 21 | Dispersion A-1 | 1.0 |
| | Dispersion B-11 | 4.9 |
| | Dispersion C-1 | 1.4 |
| | Clay | 1.5 |
| | PVA | 3.4 |
| Control 21 | Dispersion A-1 | 1.0 |
| | Dispersion B-11 | 4.9 |
| | Clay | 1.8 |
| | PVA | 3.8 |
| 22 | Dispersion A-1 | 1.0 |
| | Dispersion B-12 | 4.9 |
| | Dispersion C-1 | 1.4 |
| | Clay | 1.5 |
| | PVA | 3.4 |
| Control 22 | Dispersion A-1 | 1.0 |
| | Dispersion B-12 | 4.9 |
| | Clay | 1.8 |
| | PVA | 3.8 |
| 23 | Dispersion A-1 | 1.0 |
| | Dispersion B-13 | 4.9 |
| | Dispersion C-1 | 1.4 |
| | Clay | 1.5 |
| | PVA | 3.4 |
| Control 23 | Dispersion A-1 | 1.0 |
| | Dispersion B-13 | 4.9 |
| | Clay | 1.8 |
| | PVA | 3.8 |
| 24 | Dispersion A-1 | 1.0 |
| | Dispersion B-14 | 4.9 |
| | Dispersion C-1 | 1.4 |
| | Clay | 1.5 |
| | PVA | 3.4 |
| Control 24 | Dispersion A-1 | 1.0 |
| | Dispersion B-14 | 4.9 |
| | Clay | 1.8 |
| | PVA | 3.8 |
| 25 | Dispersion A-1 | 1.0 |
| | Dispersion B-15 | 4.9 |
| | Dispersion C-1 | 1.4 |
| | Clay | 1.5 |

TABLE 4-continued

| Example | Components | Parts |
|---|---|---|
| | PVA | 3.4 |
| Control 25 | Dispersion A-1 | 1.0 |
| | Dispersion B-15 | 4.9 |
| | Clay | 1.8 |
| | PVA | 3.8 |
| 26 | Dispersion A-1 | 1.0 |
| | Dispersion B-16 | 4.9 |
| | Dispersion C-1 | 1.4 |
| | Clay | 1.5 |
| | PVA | 3.4 |
| Control 26 | Dispersion A-1 | 1.0 |
| | Dispersion B-16 | 4.9 |
| | Clay | 1.8 |
| | PVA | 3.8 |
| 27 | Dispersion A-2 | 0.5 |
| | Dispersion B-16 | 4.9 |
| | Dispersion C-1 | 1.4 |
| | Clay | 1.5 |
| | PVA | 3.9 |
| | Water | 2.4 |
| Control 27 | Dispersion A-2 | 0.5 |
| | Dispersion B-16 | 4.9 |
| | Clay | 1.8 |
| | PVA | 3.9 |
| | Water | 2.4 |
| 28 | Dispersion A-1 | 1.0 |
| | Dispersion B-17 | 4.9 |
| | Dispersion C-1 | 1.4 |
| | Clay | 1.5 |
| | PVA | 3.4 |
| Control 28 | Dispersion A-1 | 1.0 |
| | Dispersion B-17 | 4.9 |
| | Clay | 1.8 |
| | PVA | 3.8 |
| 29 | Dispersion A-1 | 1.0 |
| | Dispersion B-18 | 4.9 |
| | Dispersion C-1 | 1.4 |
| | Clay | 1.5 |
| | PVA | 3.4 |
| Control 29 | Dispersion A-1 | 1.0 |
| | Dispersion B-18 | 4.9 |
| | Clay | 1.8 |
| | PVA | 3.8 |
| 30 | Dispersion A-1 | 1.0 |
| | Dispersion B-19 | 4.9 |
| | Dispersion C-1 | 1.4 |
| | Clay | 1.4 |
| | PVA | 3.8 |
| Control 30 | Dispersion A-1 | 1.0 |
| | Dispersion B-19 | 4.9 |
| | Clay | 1.8 |
| | PVA | 3.8 |
| 31 | Dispersion A-1 | 1.0 |
| | Dispersion B-20 | 4.9 |
| | Dispersion C-1 | 1.4 |
| | Clay | 1.5 |
| | PVA | 3.4 |
| Control 31 | Dispersion A-1 | 1.0 |
| | Dispersion B-20 | 4.9 |
| | Clay | 1.8 |
| | PVA | 3.8 |
| 32 | Dispersion A-1 | 1.0 |
| | Dispersion B-21 | 4.9 |
| | Dispersion C-1 | 1.4 |
| | Clay | 1.5 |
| | PVA | 3.4 |
| Control 32 | Dispersion A-1 | 1.0 |
| | Dispersion B-21 | 4.9 |
| | Clay | 1.8 |
| | PVA | 3.8 |
| 33 | Dispersion A-1 | 1.0 |
| | Dispersion B-22 | 4.9 |
| | Dispersion C-1 | 1.4 |
| | Clay | 1.5 |
| | PVA | 3.4 |
| Control 33 | Dispersion A-1 | 1.0 |
| | Dispersion B-22 | 4.9 |
| | Clay | 1.8 |
| | PVA | 3.8 |
| 34 | Dispersion A-1 | 1.0 |
| | Dispersion B-23 | 4.9 |

TABLE 4-continued

| Example | Components | Parts |
|---|---|---|
| | Dispersion C-1 | 1.4 |
| | Clay | 1.5 |
| | PVA | 3.4 |
| Control 34 | Dispersion A-1 | 1.0 |
| | Dispersion B-23 | 4.9 |
| | Clay | 1.8 |
| | PVA | 3.8 |
| 35 | Dispersion A-2 | 1.0 |
| | Dispersion B-24 | 4.9 |
| | Dispersion C-1 | 1.4 |
| | Clay | 1.5 |
| | PVA | 3.4 |
| Control 35 | Dispersion A-2 | 1.0 |
| | Dispersion B-24 | 4.9 |
| | Clay | 1.8 |
| | PVA | 3.8 |
| 36 | Dispersion A-1 | 1.0 |
| | Dispersion B-25 | 4.9 |
| | Dispersion C-1 | 1.4 |
| | Clay | 1.5 |
| | PVA | 3.4 |
| Control 36 | Dispersion A-1 | 1.0 |
| | Dispersion B-25 | 4.9 |
| | Clay | 1.8 |
| | PVA | 3.8 |
| 37 | Dispersion A-1 | 1.0 |
| | Dispersion B-26 | 4.9 |
| | Dispersion C-1 | 1.4 |
| | Clay | 1.5 |
| | PVA | 3.4 |
| Control 37 | Dispersion A-1 | 1.0 |
| | Dispersion B-26 | 4.9 |
| | Clay | 1.8 |
| | PVA | 3.8 |
| 38 | Dispersion A-1 | 1.0 |
| | Dispersion B-27 | 3.9 |
| | Dispersion C-1 | 1.4 |
| | Clay | 1.5 |
| | PVA | 3.8 |
| Control 38 | Dispersion A-1 | 1.0 |
| | Dispersion B-27 | 3.9 |
| | Clay | 1.8 |
| | PVA | 3.8 |
| 39 | Dispersion A-6 | 1.0 |
| | Dispersion B-1 | 4.9 |
| | Dispersion C-1 | 1.4 |
| | Clay | 1.4 |
| | PVA | 3.4 |
| | Water | 2.5 |
| Control 39 | Dispersion A-6 | 1.0 |
| | Dispersion B-1 | 4.9 |
| | Clay | 1.8 |
| | PVA | 3.8 |
| | Water | 2.5 |
| Control 40 | Dispersion A-1 | 1.0 |
| | Dispersion C-1 | 13.0 |
| Control 41 | Dispersion A-1 | 1.0 |
| | Dispersion C-2 | 4.9 |
| | Clay | 1.8 |
| | PVA | 3.8 |
| Control 42 | Dispersion A-2 | 1.0 |
| | Dispersion C-1 | 4.9 |
| | Clay | 1.8 |
| | PVA | 3.8 |
| 43 | Dispersion A-1 | 1.0 |
| | Dispersion B-28 | 7.0 |
| | Dispersion C-1 | 1.4 |
| | Clay | 0.9 |
| | PVA | 2.0 |
| | Water | 0.9 |
| Control 43 | Dispersion A-1 | 1.0 |
| | Dispersion B-28 | 7.0 |
| | Clay | 1.3 |
| | PVA | 2.4 |
| | Water | 1.5 |
| 44 | Dispersion A-1 | 1.0 |
| | Dispersion B-29 | 7.0 |
| | Dispersion C-1 | 1.4 |
| | Clay | 1.2 |
| | PVA | 2.0 |
| | Water | 0.6 |

TABLE 4-continued

| Example | Components | Parts |
|---|---|---|
| Control 44 | Dispersion A-1 | 1.0 |
| | Dispersion B-29 | 7.0 |
| | Clay | 1.3 |
| | PVA | 2.4 |
| | Water | 1.5 |
| 45 | Dispersion A-1 | 1.0 |
| | Dispersion B-30 | 4.9 |
| | Dispersion C-1 | 1.4 |
| | Clay | 1.5 |
| | PVA | 2.3 |
| | Water | 1.8 |
| Control 45 | Dispersion A-1 | 1.0 |
| | Dispersion B-30 | 4.9 |
| | Clay | 1.8 |
| | PVA | 3.0 |
| | Water | 2.5 |
| 46 | Dispersion A-1 | 1.0 |
| | Dispersion B-31 | 4.9 |
| | Dispersion C-1 | 1.4 |
| | Clay | 1.5 |
| | PVA | 2.6 |
| | Water | 1.8 |
| Control 46 | Dispersion A-1 | 1.0 |
| | Dispersion B-31 | 4.9 |
| | Clay | 1.8 |
| | PVA | 3.0 |
| | Water | 2.5 |
| 47 | Dispersion A-1 | 1.0 |
| | Dispersion B-32 | 4.9 |
| | Dispersion C-1 | 1.4 |
| | Clay | 1.5 |
| | PVA | 2.6 |
| | Water | 1.8 |
| Control 47 | Dispersion A-1 | 1.0 |
| | Dispersion B-32 | 4.9 |
| | Clay | 1.8 |
| | PVA | 3.0 |
| | Water | 2.5 |
| 48 | Dispersion A-1 | 1.0 |
| | Dispersion B-33 | 4.9 |
| | Dispersion C-1 | 1.4 |
| | Clay | 1.4 |
| | PVA | 2.6 |
| | Water | 1.9 |

TABLE 4-continued

| Example | Components | Parts |
|---|---|---|
| Control 48 | Dispersion A-1 | 1.0 |
| | Dispersion B-33 | 4.9 |
| | Clay | 1.8 |
| | PVA | 3.0 |
| | Water | 2.5 |
| 49 | Dispersion A-1 | 1.0 |
| | Dispersion B-34 | 4.9 |
| | Dispersion C-1 | 1.4 |
| | Clay | 1.4 |
| | PVA | 2.6 |
| | Water | 1.9 |
| Control 49 | Dispersion A-1 | 1.0 |
| | Dispersion B-34 | 4.9 |
| | Clay | 1.8 |
| | PVA | 3.0 |
| | Water | 2.5 |
| 50 | Dispersion A-1 | 1.0 |
| | Dispersion B-35 | 6.4 |
| | Dispersion C-1 | 1.4 |
| | Clay | 1.0 |
| | PVA | 2.7 |
| | Water | 0.7 |
| Control 50 | Dispersion A-1 | 1.0 |
| | Dispersion B-35 | 6.4 |
| | Clay | 1.3 |
| | PVA | 3.1 |
| | Water | 1.4 |

Each of the mixtures of Table 4 was applied to paper at a weight of about 5.2 to about 5.9 gsm dry coat weight.

Each of thermally-sensitive record material sheets coated with one of the mixtures of Table 4 was imaged by contacting the coated sheet with a metallic imaging block at the indicated temperature for 5 seconds. The intensity of each image was measured by means of a reflectance reading using a Bausch & Lomb Opacimeter. A reading of 100 indicates no discernable image and low value indicates good image development. The intensity of the image of each Example is presented in Table 5.

TABLE 5

| | Reflectance Intensity of Image Developed at Indicated Fahrenheit Temperature | | | | | | | | | | |
|---|---|---|---|---|---|---|---|---|---|---|---|
| Example | 300° | 275° | 60° | 245° | 230° | 215° | 200° | 185° | 170° | 155° | 140° |
| 1 | 8.1 | 8.1 | 8.1 | 8.0 | 8.4 | 10.0 | 13.8 | 91.0 | 100.0 | 100.0 | 100.0 |
| Control 1 | 10.6 | 19.9 | 34.3 | 53.6 | 78.0 | 100.0 | 100.0 | 100.0 | 100.0 | 100.0 | 100.0 |
| 2-1 | 8.4 | 9.5 | 10.2 | 12.1 | 20.8 | 27.7 | 41.5 | 59.8 | 100.0 | 100.0 | 100.0 |
| 2-2 | 8.8 | 9.7 | 12.1 | 15.2 | 15.7 | 20.1 | 26.0 | 56.0 | 100.0 | 100.0 | 100.0 |
| 2-3 | 15.0 | 20.0 | 22.0 | 22.0 | 25.0 | 27.0 | 33.0 | 38.0 | 87.0 | 100.0 | 100.0 |
| Control 2 | 9.8 | 13.4 | 20.4 | 33.9 | 43.0 | 100.0 | 100.0 | 100.0 | 100.0 | 100.0 | 100.0 |
| 3 | 8.0 | 7.9 | 8.0 | 12.7 | 13.6 | 16.3 | 25.0 | 43.6 | 100.0 | 100.0 | 100.0 |
| Control 3 | 7.5 | 7.2 | 8.4 | 19.9 | 54.0 | 78.9 | 100.0 | 100.0 | 100.0 | 100.0 | 100.0 |
| 4 | 8.2 | 8.2 | 8.5 | 9.4 | 17.2 | 63.8 | 100.0 | 100.0 | 100.0 | 100.0 | 100.0 |
| Control 4 | 8.2 | 8.5 | 10.5 | 16.0 | 39.3 | 77.8 | 94.0 | 100.0 | 100.0 | 100.0 | 100.0 |
| 5 | 8.9 | 9.8 | 9.9 | 11.1 | 12.9 | 17.0 | 24.8 | 60.0 | 91.0 | 100.0 | 100.0 |
| Control 5 | 9.0 | 10.6 | 15.3 | 26.0 | 48.5 | 78.6 | 94.5 | 100.0 | 100.0 | 100.0 | 100.0 |
| 6 | 9.0 | 9.0 | 9.5 | 10.2 | 12.7 | 17.8 | 25.4 | 38.5 | 93.3 | 100.0 | 100.0 |
| Control 6 | 7.8 | 8.0 | 11.9 | 18.5 | 52.7 | 80.6 | 96.7 | 100.0 | 100.0 | 100.0 | 100.0 |
| 7 | 21.3 | 26.7 | 31.8 | 36.1 | 46.2 | 53.0 | 64.2 | 87.1 | 100.0 | 100.0 | 100.0 |
| Control 7 | 26.9 | 40.1 | 48.9 | 57.5 | 77.4 | 91.6 | 100.0 | 100.0 | 100.0 | 100.0 | 100.0 |
| 8 | 14.4 | 21.8 | 29.1 | 37.1 | 44.1 | 54.9 | 55.7 | 67.8 | 97.6 | 100.0 | 100.0 |
| Control 8 | 18.4 | 30.0 | 41.0 | 53.4 | 66.7 | 78.4 | 88.3 | 100.0 | 100.0 | 100.0 | 100.0 |
| 9 | 7.3 | 7.5 | 7.5 | 7.9 | 8.0 | 8.7 | 9.8 | 10.2 | 15.2 | 72.5 | 100.0 |
| Control 9 | 6.4 | 6.4 | 6.5 | 6.5 | 6.7 | 7.7 | 10.5 | 17.9 | 64.2 | 100.0 | 100.0 |
| 10 | 8.1 | 8.6 | 9.1 | 9.6 | 11.1 | 15.0 | 20.1 | 43.9 | 93.7 | 100.0 | 100.0 |
| Control 10 | 8.3 | 8.9 | 9.8 | 13.4 | 25.5 | 61.9 | 89.9 | 100.0 | 100.0 | 100.0 | 100.0 |
| 11 | 14.5 | 15.9 | 16.0 | 24.5 | 32.9 | 39.9 | 53.1 | 79.4 | 96.2 | 100.0 | 100.0 |
| Control 11 | 19.2 | 20.7 | 30.9 | 43.6 | 57.8 | 85.6 | 100.0 | 100.0 | 100.0 | 100.0 | 100.0 |
| 12 | 29.5 | 27.6 | 24.7 | 34.6 | 60.0 | 78.0 | 85.0 | 87.0 | 100.0 | 100.0 | 100.0 |
| Control 12 | 13.8 | 12.5 | 24.3 | 71.6 | 90.6 | 100.0 | 100.0 | 100.0 | 100.0 | 100.0 | 100.0 |
| 13 | 8.6 | 8.6 | 8.8 | 8.8 | 9.1 | 11.1 | 14.8 | 21.2 | 60.7 | 100.0 | 100.0 |
| Control 13 | 8.9 | 8.8 | 8.3 | 10.0 | 16.2 | 35.0 | 73.0 | 87.0 | 100.0 | 100.0 | 100.0 |
| 14 | 20.5 | 23.2 | 25.2 | 27.7 | 33.3 | 37.3 | 44.9 | 61.6 | 94.0 | 100.0 | 100.0 |
| Control 14 | 22.1 | 28.7 | 38.2 | 42.7 | 57.2 | 70.8 | 94.5 | 100.0 | 100.0 | 100.0 | 100.0 |

TABLE 5-continued

| Example | Reflectance Intensity of Image Developed at Indicated Fahrenheit Temperature | | | | | | | | | | |
|---|---|---|---|---|---|---|---|---|---|---|---|
| | 300° | 275° | 60° | 245° | 230° | 215° | 200° | 185° | 170° | 155° | 140° |
| 15 | 7.0 | 7.6 | 7.7 | 7.9 | 9.2 | 12.4 | 19.5 | 31.6 | 68.4 | 96.8 | 100.0 |
| Control 15 | 7.6 | 7.9 | 8.9 | 16.5 | 44.5 | 59.4 | 78.8 | 94.1 | 100.0 | 100.0 | 100.0 |
| 16 | 7.3 | 7.8 | 9.2 | 12.1 | 18.3 | 24.5 | 39.0 | 63.1 | 100.0 | 100.0 | 100.0 |
| Control 16 | 9.5 | 10.9 | 21.6 | 40.6 | 70.0 | 89.0 | 98.0 | 100.0 | 100.0 | 100.0 | 100.0 |
| 17 | 6.4 | 6.8 | 6.8 | 7.2 | 9.8 | 13.8 | 22.6 | 42.4 | 89.2 | 100.0 | 100.0 |
| Control 17 | 6.8 | 7.0 | 7.0 | 11.7 | 40.0 | 82.0 | 93.0 | 100.0 | 100.0 | 100.0 | 100.0 |
| 18 | 6.4 | 6.7 | 7.1 | 9.7 | 18.1 | 30.3 | 47.2 | 76.4 | 91.6 | 100.0 | 100.0 |
| Control 18 | 5.7 | 6.0 | 9.1 | 19.3 | 40.6 | 90.2 | 100.0 | 100.0 | 100.0 | 100.0 | 100.0 |
| 19 | 18.5 | 20.6 | 21.9 | 23.8 | 24.5 | 27.8 | 36.5 | 50.3 | 85.9 | 100.0 | 100.0 |
| Control 19 | 10.5 | 10.6 | 11.2 | 11.9 | 14.0 | 38.0 | 73.0 | 100.0 | 100.0 | 100.0 | 100.0 |
| 20 | 8.5 | 9.0 | 9.4 | 9.7 | 10.1 | 11.2 | 16.9 | 49.2 | 89.3 | 100.0 | 100.0 |
| Control 20 | 8.7 | 9.2 | 9.5 | 11.1 | 12.6 | 13.3 | 26.7 | 84.2 | 100.0 | 100.0 | 100.0 |
| 21 | 8.3 | 8.9 | 10.4 | 18.0 | 47.1 | 70.0 | 85.0 | 91.0 | 100.0 | 100.0 | 100.0 |
| Control 21 | 10.3 | 12.1 | 22.0 | 45.3 | 77.3 | 87.0 | 100.0 | 100.0 | 100.0 | 100.0 | 100.0 |
| 22 | 36.0 | 67.4 | 81.0 | 88.0 | 100.0 | 100.0 | 100.0 | 100.0 | 100.0 | 100.0 | 100.0 |
| Control 22 | 100.0 | 100.0 | 100.0 | 100.0 | 100.0 | 100.0 | 100.0 | 100.0 | 100.0 | 100.0 | 100.0 |
| 23 | 8.2 | 8.1 | 8.5 | 8.7 | 8.6 | 10.1 | 11.8 | 18.9 | 46.2 | 93.0 | 100.0 |
| Control 23 | 8.6 | 8.6 | 7.9 | 8.5 | 9.5 | 19.2 | 63.3 | 90.0 | 100.0 | 100.0 | 100.0 |
| 24 | 8.5 | 13.9 | 20.0 | 31.2 | 40.2 | 50.6 | 62.8 | 83.5 | 100.0 | 100.0 | 100.0 |
| Control 24 | 13.1 | 35.2 | 84.1 | 94.0 | 100.0 | 100.0 | 100.0 | 100.0 | 100.0 | 100.0 | 100.0 |
| 25 | 18.0 | 26.8 | 40.0 | 56.1 | 74.0 | 85.0 | 93.0 | 100.0 | 100.0 | 100.0 | 100.0 |
| Control 25 | 47.0 | 76.0 | 87.0 | 90.0 | 100.0 | 100.0 | 100.0 | 100.0 | 100.0 | 100.0 | 100.0 |
| 26 | 6.7 | 7.6 | 10.2 | 16.3 | 27.9 | 38.1 | 49.7 | 62.1 | 100.0 | 100.0 | 100.0 |
| Control 26 | 7.2 | 10.2 | 32.5 | 70.9 | 94.0 | 100.0 | 100.0 | 100.0 | 100.0 | 100.0 | 100.0 |
| 27 | 21.8 | 26.3 | 31.3 | 35.9 | 41.1 | 56.2 | 72.9 | 93.3 | 100.0 | 100.0 | 100.0 |
| Control 27 | 32.1 | 45.7 | 53.6 | 70.0 | 88.0 | 96.7 | 100.0 | 100.0 | 100.0 | 100.0 | 100.0 |
| 28 | 7.5 | 7.6 | 9.6 | 12.6 | 24.2 | 32.8 | 45.8 | 67.9 | 100.0 | 100.0 | 100.0 |
| Control 28 | 6.1 | 7.5 | 13.4 | 34.9 | 87.8 | 100.0 | 100.0 | 100.0 | 100.0 | 100.0 | 100.0 |
| 29 | 7.4 | 7.7 | 8.3 | 12.6 | 15.0 | 24.8 | 45.1 | 89.4 | 100.0 | 100.0 | 100.0 |
| Control 29 | 8.5 | 10.2 | 13.0 | 18.0 | 25.0 | 31.1 | 81.0 | 100.0 | 100.0 | 100.0 | 100.0 |
| 30 | 7.2 | 7.6 | 8.6 | 10.1 | 12.9 | 16.3 | 25.9 | 57.0 | 93.0 | 100.0 | 100.0 |
| Control 30 | 8.1 | 10.4 | 13.1 | 18.3 | 23.9 | 34.4 | 53.9 | 89.0 | 100.0 | 100.0 | 100.0 |
| 31 | 27.0 | 35.2 | 52.9 | 72.3 | 80.5 | 88.0 | 90.1 | 100.0 | 100.0 | 100.0 | 100.0 |
| Control 31 | 93.6 | 100.0 | 100.0 | 100.0 | 100.0 | 100.0 | 100.0 | 100.0 | 100.0 | 100.0 | 100.0 |
| 32 | 8.3 | 9.5 | 10.1 | 11.3 | 13.1 | 16.1 | 21.6 | 32.0 | 91.6 | 100.0 | 100.0 |
| Control 32 | 14.1 | 19.9 | 31.3 | 42.4 | 67.8 | 85.3 | 100.0 | 100.0 | 100.0 | 100.0 | 100.0 |
| 33 | 8.5 | 9.6 | 12.7 | 18.5 | 26.8 | 33.4 | 49.8 | 91.8 | 100.0 | 100.0 | 100.0 |
| Control 33 | 24.1 | 65.3 | 92.7 | 100.0 | 100.0 | 100.0 | 100.0 | 100.0 | 100.0 | 100.0 | 100.0 |
| 34 | 8.3 | 8.7 | 9.0 | 10.3 | 12.0 | 15.9 | 22.1 | 49.4 | 95.3 | 100.0 | 100.0 |
| Control 34 | 7.8 | 7.9 | 8.5 | 10.0 | 16.5 | 36.2 | 85.8 | 100.0 | 100.0 | 100.0 | 100.0 |
| 35 | 33.4 | 33.2 | 34.1 | 35.0 | 39.0 | 58.0 | 74.0 | 86.0 | 95.0 | 100.0 | 100.0 |
| Control 35 | 25.1 | 25.1 | 27.4 | 31.6 | 54.6 | 84.1 | 92.5 | 100.0 | 100.0 | 100.0 | 100.0 |
| 36 | 7.5 | 8.5 | 10.4 | 12.7 | 17.4 | 22.5 | 29.2 | 56.9 | 100.0 | 100.0 | 100.0 |
| Control 36 | 11.8 | 23.7 | 29.9 | 36.4 | 46.0 | 54.2 | 76.4 | 97.1 | 100.0 | 100.0 | 100.0 |
| 37 | 19.2 | 28.6 | 42.2 | 54.4 | 65.0 | 76.2 | 80.4 | 94.6 | 100.0 | 100.0 | 100.0 |
| Control 37 | 93.1 | 100.0 | 100.0 | 100.0 | 100.0 | 100.0 | 100.0 | 100.0 | 100.0 | 100.0 | 100.0 |
| 38 | 21.0 | 28.9 | 44.0 | 54.5 | 67.8 | 79.9 | 88.8 | 100.0 | 100.0 | 100.0 | 100.0 |
| Control 38 | 35.1 | 81.5 | 94.0 | 100.0 | 100.0 | 100.0 | 100.0 | 100.0 | 100.0 | 100.0 | 100.0 |
| 39 | 6.0 | 6.9 | 9.6 | 13.7 | 21.4 | 29.6 | 46.6 | 82.0 | 100.0 | 100.0 | 100.0 |
| Control 39 | 7.1 | 12.7 | 57.7 | 86.5 | 94.4 | 100.0 | 100.0 | 100.0 | 100.0 | 100.0 | 100.0 |
| Control 40 | 50.8 | 59.6 | 61.6 | 64.2 | 66.1 | 68.8 | 69.9 | 81.9 | 100.0 | 100.0 | 100.0 |
| Control 41 | 73.7 | 73.7 | 73.7 | 91.0 | 100.0 | 100.0 | 100.0 | 100.0 | 100.0 | 100.0 | 100.0 |
| Control 42 | 72.9 | 75.6 | 77.4 | 80.9 | 81.8 | 81.0 | 84.4 | 92.7 | 100.0 | 100.0 | 100.0 |
| 43 | 8.4 | 9.8 | 9.9 | 9.8 | 12.2 | 14.6 | 19.6 | 44.6 | 89.1 | 100.0 | 100.0 |
| Control 43 | 8.0 | 10.9 | 11.3 | 14.1 | 17.3 | 22.0 | 35.8 | 87.4 | 100.0 | 100.0 | 100.0 |
| 44 | 7.5 | 8.6 | 9.6 | 10.5 | 14.0 | 20.1 | 31.3 | 92.3 | 100.0 | 100.0 | 100.0 |
| Control 44 | 7.3 | 8.3 | 10.0 | 12.3 | 80.5 | 100.0 | 100.0 | 100.0 | 100.0 | 100.0 | 100.0 |
| 45 | 22.2 | 36.4 | 47.5 | 53.0 | 66.7 | 69.6 | 85.4 | 100.0 | 100.0 | 100.0 | 100.0 |
| Control 45 | 58.9 | 76.8 | 83.1 | 87.8 | 93.6 | 100.0 | 100.0 | 100.0 | 100.0 | 100.0 | 100.0 |
| 46 | 7.3 | 8.2 | 9.2 | 12.0 | 15.0 | 21.0 | 31.3 | 55.5 | 100.0 | 100.0 | 100.0 |
| Control 46 | 12.3 | 21.2 | 37.5 | 49.6 | 65.6 | 81.7 | 92.7 | 100.0 | 100.0 | 100.0 | 100.0 |
| 47 | 6.6 | 6.7 | 7.0 | 7.2 | 7.5 | 9.0 | 13.4 | 26.3 | 100.0 | 100.0 | 100.0 |
| Control 47 | 7.3 | 7.6 | 7.8 | 8.5 | 12.3 | 28.5 | 75.5 | 100.0 | 100.0 | 100.0 | 100.0 |
| 48 | 11.1 | 9.8 | 10.1 | 11.6 | 12.6 | 13.7 | 15.9 | 17.8 | 22.5 | 64.5 | 100.0 |
| Control 48 | 9.2 | 10.1 | 11.1 | 11.9 | 12.7 | 14.3 | 15.5 | 18.1 | 47.0 | 100.0 | 100.0 |
| 49 | 6.2 | 6.4 | 6.9 | 7.2 | 7.7 | 8.1 | 10.4 | 19.3 | 49.4 | 91.2 | 100.0 |
| Control 49 | 6.7 | 6.5 | 6.6 | 6.9 | 7.4 | 9.3 | 15.8 | 48.5 | 87.9 | 100.0 | 100.0 |
| 50 | 6.9 | 7.5 | 8.5 | 10.9 | 16.6 | 30.0 | 60.7 | 100.0 | 100.0 | 100.0 | 100.0 |
| Control 50 | 7.6 | 10.4 | 31.4 | 81.0 | 100.0 | 100.0 | 100.0 | 100.0 | 100.0 | 100.0 | 100.0 |

From the data of Table 5 it is readily apparent that thermally-responsive recording materials comprising phenylhydroxynaphthoate possess improved thermal response and/or enhanced image intensity compared to corresponding thermally-responsive recording material in which the phenylhydroxynaphthoate is omitted.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A thermally-responsive record material comprising a support member bearing a thermally-sensitive color-forming composition comprising chromogenic material and acidic developer material in contiguous relationship, whereby the melting or sublimation of either material produces a change in color by reaction between the two, a phenylhydroxynaphthoate compound selected from the group consisting of phenyl-1-hydroxy-2-naphthoate, phenyl-3-hydroxy-2-naphthoate and mixtures thereof, and a suitable binder therefor.

2. The record material of claim 1 in which the phenylhydroxynaphthoate compound is phenyl-1-hydroxy-2-naphthoate.

3. The record material of claim 1 in which the acidic developer material is a phenol compound.

4. The record material of claim 3 in which the phenol compound is selected from the group consisting of 4,4'-isopropylindinediphenol, ethyl-4,4-bis(4-hydroxyphenyl)-pentanoate, n-propyl-4,4-bis(4-hydroxyphenyl)pentanoate, isopropyl-4,4-bis(4-hydroxyphenyl)pentanoate, methyl-4,4-bis(4-hydroxyphenyl)-pentanoate, 2,2-bis(4-hydroxyphenyl)-4-methylpentane, p-hydroxybenzophenone, 2,4-dihydroxybenzophenone, 1,1-bis(4-hydroxyphenyl)cyclohexane and mixtures thereof.

5. The record material of claim 4 in which the phenol compound is 4,4'-isopropylidenediphenol.

6. The record material of claim 4 in which the phenol compound is isopropyl-4,4-bis(4-hydroxyphenyl)pentanoate.

7. The record material of claim 1 in which the chromogenic material is selected from the group consisting of 3-diethylamino-6-methyl-7-anilinofluoran; 7-(1-ethyl-2-methylindol-3-yl)-7-(4-diethylamino-2-ethoxyphenyl)-5,7-dihydrofuro[3,4-b]pyridin-5-one; 3-diethylamino-7-(2-chloroanilino)fluoran; 3-(N-methylcyclohexylamino)-6-methyl-7-anilinofluoran; 7-(1-octyl-2-methylindol-3-yl)-7-(4-diethylamino-2-ethoxyphenyl)-5,7-dihydrofuro[3,4-b]pyridin-5-one; 3'-phenyl-7-dibenzylamino-2,2'-spiro-di-[2H-1-benzopyran] and mixtures thereof.

8. The record material of claim 7 in which the chromogenic material is 3-diethylamino-6-methyl-7-anilinofluoran.

9. The record material of claim 1, 5, 6 or 8 in which the binder is selected from the group consisting of polyvinyl alcohol, methylcellulose, methyl-hydroxypropylcellulose, starch, hydroxyethylcellulose and mixtures thereof.

10. The record material of claim 9 in which the binder is selected from the group consisting of polyvinyl alcohol, methylcellulose, starch and a mixture thereof.

11. The record material of claim 10 in which the binder is a mixture of polyvinyl alcohol, methylcellulose and starch.

* * * * *